United States Patent [19]

Wicks

[11] 4,380,187

[45] Apr. 19, 1983

[54] METHOD AND SYSTEM FOR PROVIDING LIFE-SUSTAINING AIR TO PERSONS ENTRAPPED WITHIN A BURNING BUILDING

[76] Inventor: Edward A. Wicks, 93 Long Ridge Rd., Danbury, Conn. 06810

[21] Appl. No.: 260,903

[22] Filed: May 6, 1981

[51] Int. Cl.[3] ..... F24F 7/06

[52] U.S. Cl. ..... 98/39; 98/37

[58] Field of Search ..... 98/29, 37, 39; 169/16, 169/48, 54, 56

[56] References Cited

U.S. PATENT DOCUMENTS

| | | | |
|---|---|---|---|
| 465,298 | 12/1891 | Timby | 98/39 |
| 2,299,793 | 10/1942 | Cannaday et al. | 128/205.25 |
| 4,054,084 | 10/1977 | Palmer | 98/39 |
| 4,320,756 | 3/1982 | Holmes | 128/200.24 |

FOREIGN PATENT DOCUMENTS

| | | | |
|---|---|---|---|
| 20849 | of 1909 | United Kingdom | 98/39 |

*Primary Examiner*—Albert J. Makay
*Assistant Examiner*—Harold Joyce
*Attorney, Agent, or Firm*—Parmelee, Bollinger & Bramblett

[57] ABSTRACT

The present invention provides a method and system for providing air to persons entrapped within a burning structure to sustain life until rescuers arrive. The system advantageously utilizes existing water pipes to feed the air at elevated pressure to the trapped occupants. These persons, upon finding their route of escape blocked by the fire or by smoke, retreat into a predetermined refuge room, a bathroom usually or a washroom, and place wet towels, curtains, blankets, etc. against the door to aid in excluding smoke. The pressurized air being supplied through the pipes into the refuge room advantageously raises the pressure therein and thereby prevents the entry of undue amounts of smoke while at the same time replenishing the breathable air within the room.

21 Claims, 1 Drawing Figure

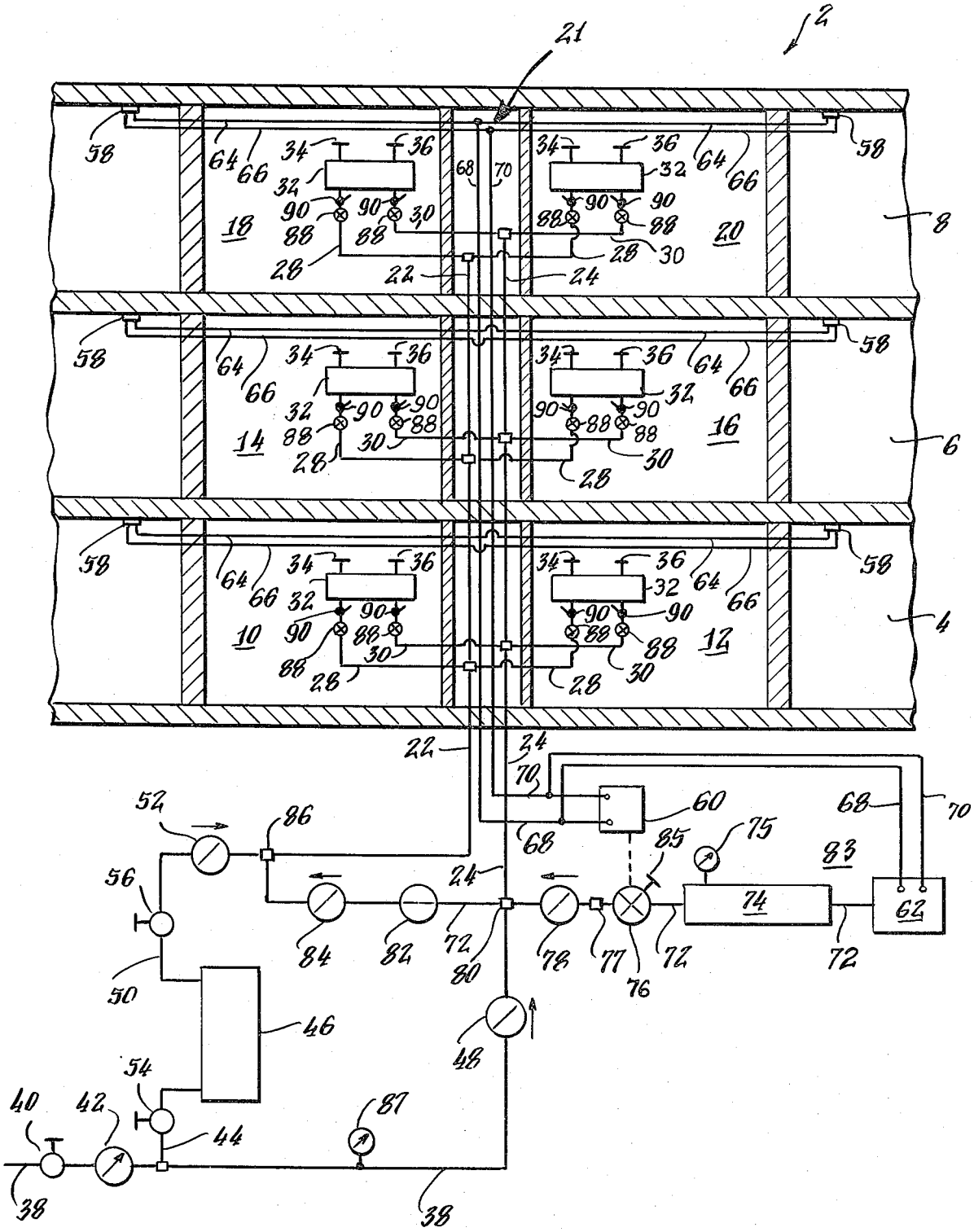
2
21
58
64
66
34
36
32
90
88
30
28
18
20
14
16
10
12
8
6
4
22
24
68
70
60
52
86
56
50
46
54
40
42
44
38
87
84
82
72
80
78
77
76
75
85
83
74
62
48

METHOD AND SYSTEM FOR PROVIDING LIFE-SUSTAINING AIR TO PERSONS ENTRAPPED WITHIN A BURNING BUILDING

BACKGROUND OF THE INVENTION

Fires in high-rise, multiple dwelling structures, such as apartment buildings, hotels, motels and office buildings, are a serious source of concern to people who either live in or temporarily reside in such premises. Fires with the resultant intense smoke and fume generation are particularly devasting in high-rise structures in which a large number of people may be entrapped. Furthermore, by their very nature, high-rise structures present physical impediments to rapid rescue attempts, particularly with regard to persons who may be entrapped on the upper levels of such structures. Accordingly, the time elapsing between the initial outbreak of a fire and the arrival of the rescue team at a room on an upper floor may be relatively great.

Most fire-related deaths are not caused by the fire directly, but result from the toxic fumes and smoke generated by the fire. A common procedure for entrapped persons, whose escape has been blocked or the route is unknown, is to await rescue by isolating themselves as much as possible from the fumes and smoke of the fire. This isolation is generally attempted by huddling within a small room (e.g., the bathroom) with the door closed, and for example, by placing wet materials against the bottom of the door and the floor to prevent fumes and smoke from entering. The difficulty resulting from this procedure is that there is only a limited amount of breathable air within the isolated room, and there may be no means for providing fresh air. (For example, there may be no windows in the bathroom or the smoke rising around the building from lower floors may dictate that the bathroom window must remain closed). In spite of the barricading efforts by those who are trapped, smoke and fumes quickly begin seeping into the place of refuge, and thus asphyxiation or smoke poisoning may soon result unless rescuers arrive almost immediately.

Existing fire protection systems do not attempt to solve the above problem. For example, the object of sprinkler systems is to put out the fire, but such systems do not provide fresh air to entrapped persons.

It has also been proposed (Letter to the Editor, New York Times, Feb. 14, 1981, Charles F. Sepsy) to "modify a building's heating and cooling system so that air can be pumped into the area adjacent to the fire" so that "an invisible curtain can be placed around the flames, and smoke as well as gases can be exhausted to the outdoors". Apart from the fact that this proposed system would appear to require a very complicated system of baffles and zones to prevent inadvertent force feeding of oxygen to the fire, its purpose is to isolate the fire to allow entrapped occupants time to escape. This proposed system does not provide fresh air to those unable to escape before rescuers arrive. Furthermore, the large ducts which are characteristic of existing heating and cooling systems tend to serve as channels for conducting hot smoke and fumes into the rooms on the upper floors. Thus, occupants trapped in a bathroom on an upper floor would likely be forced to block the mouth of any air conditioning or heating duct which opened into the bathroom for preventing overheated air, smoke and fumes from flooding into their place of refuge.

It is an object of the present invention to provide a reliable and relatively simple system advantageously utilizing existing small-diameter hot and cold water feed pipes in a building to provide fresh air to occupants entrapped within predetermined rooms of refuge in the building to sustain life and to aid in excluding smoke and fumes from the isolated room until rescuers arrive.

SUMMARY OF THE INVENTION

The present invention provides a method and system for providing fresh air to occupants entrapped within a burning building. The system advantageously utilizes existing hot and cold water supply lines to jet pressurized air to individual predetermined refuge rooms in the respective occupancy units within the premises. Such refuge rooms are usually the bathrooms. The occupants, upon finding themselves trapped, retreat into the predetermined room and take steps to exclude the entry of smoke, fumes or overheated air, usually placing wet towels or wet blankets or drapes against the inside of the door. Pressurized air is fed through the small-diameter water pipes into the refuge room, thereby advantageously raising the pressure within this shelter for aiding in excluding noxious gases and overheated air while replenishing the life-sustaining breathable air in the room. Thus, the occupants are bathed in a life-sustaining, smoke-excluding atmosphere of slightly elevated pressure, until the rescue team can arrive.

In the system as shown there is a source of compressed air and actuator means for automatically commencing the flow from this source. The actuator is connected to a plurality of fire sensors located in the different occupancy units within the building. Upon detection of a fire, the source of pressurized air is actuated to supply such air through the water supply pipes. The pressure of the compressed air is greater than that of the water in either the hot or cold supply line, and as such, there is insignificant water flow through the lines while the compressed air is being jetted through these lines. The system advantageously uses check valves and pressure-sensitive valves to interconnect the hot and cold water supply lines, yet prevents mixing of the hot and cold water. In this manner, compressed air can be provided through both the hot and cold water lines simultaneously via a pipeline from the compressed air source interconnecting the main hot and cold water supply lines.

Pressure-responsive release valves are connected to the hot and cold water lines in the respective bathrooms. These release valves automatically allow the pressurized air to enter the respective rooms of refuge in case the occupants are panicked and forget or do not realize that the hot and cold faucets should be opened to admit breathable pressurized air into their isolated room.

BRIEF DESCRIPTION OF THE DRAWING

The drawing illustrates an elevational sectional view of a high-rise building structure incorporating one embodiment of a system in accordance with the present invention for providing pressurized breathable air to trapped fire victims using existing hot and cold water feed pipes in the existing structure for feeding the pressurized air to the respect rooms of refuge.

DETAILED DESCRIPTION

The drawing illustrates an elevational view, in section, of a high-rise building structure 2, which may be, for example, an apartment house, a motel, a hotel, office building, or the like. For illustrative purposes, three levels or stories of the building are shown by reference numerals 4, 6 and 8. On each level of the building, there are shown two occupancy units i.e., suites or apartments or offices, having bathrooms illustrated by the numbers 10, 12, 14, 16, 18 and 20, respectively. The occupancy units in existing buildings are often arranged so that the bathrooms share a common vertical wall space 21 containing common main hot and cold water feed pipes, 22 and 24, respectively, sometimes called risers, which run up through the common wall 21 separating the occupancy units on each level of the building.

In this embodiment of the invention the predetermined refuge rooms are the bathrooms 10, 12, 14, 16, 18 and 20. Hot and cold water pipes 28 and 30, respectively, branch out from their respective main feed pipes 22 and 24 into the bathroom of each apartment. In the drawing, the pipes 28 and 30 are shown connected to sinks 32 in each bathroom. Each sink has a hot water faucet 34 and a cold water faucet 36.

Water is supplied into the building to the feed lines 22 and 24 from a trunk or main supply inlet line 38. When water is used, the water pressure forces the water past a manually operated main shut-off valve 40 and through a meter 42. A pipe 44 leading to water heating means 46, for example, a water heater, connects with the main supply line 38, so that a portion of the water initially flowing into the supply line 38 may flow through pipe 44 and into the water heater. Water is also fed from the trunk line 38, past a check valve 48, and directly into the cold water feed pipe 24. Water flowing from the water heater 46 flows out an outlet pipe 50 coupled to the water heater, past a check valve 52, and directly into the hot water feed line 22. Shut-off valves 54 and 56, disposed in the inlet pipe 44 and in the outlet pipe 50 leading into and out of the water heater 46, are provided to manually cut off water flow through the heater in case of need to provide maintenance or otherwise service the water heater 46.

A plurality of fire sensors or detectors 58 are positioned throughout the building 2 in the respective occupancy units. For illustrative purposes, each of the occupancy units includes at least one fire detector 58 mounted in a room adjacent to the bathroom in that occupancy unit. Such fire detectors 58 are commercially available and several different types of those detectors are known. Generally speaking, a fire detector or sensor is a device which provide an electrical signal in response to either a threshold level of smoke or ionized particles in its immediate proximity or a threshold level of temperature. The electrical signal actuates alarm means to indicate to occupants the existence of a fire.

In the present embodiment of the invention, the fire detectors 58 in addition to being connected to alarm means (not shown) are electrically coupled to a valve actuator 60 and an air compressor 62. Specifically, each fire detector is connected by wires 64 and 66 to a main control circuit including wires 68 and 70. This control circuit is connected to both the valve actuator and to the air compressor. When one of the detectors 58 provide a signal over the control circuit 68, 70, the valve actuator 60 opens an air valve 76 and the compressor 62 is automatically started. This compressor 62 may be driven by a gasoline or diesel engine. This compressor 62 includes an electrical starter motor and storage batteries for energizing the starter motor. These batteries are always maintained fully charged by a trickle charger, as is known in the storage battery art, so that the compressor is ready to be automatically started at any moment.

An air line 72 connects the compressor 62 to a large compressed air receiver storage tank 74. This storage tank 74 is relatively large and is maintained fully loaded with compressed air at an elevated pressure, for example at a predetermined pressure level in the range from 100 to 300 pounds per square inch (p.s.i.) as indicated by a pressure gage 75. The size of this tank 74 and its pressure gage 75 are sufficient to maintain the compressed air flow through the lines 22 and 24 to the trapped occupants until the compressor 62 has been started and is running at its full rated output. The air line extends from the storage tank 74, through the shut-off valve 76 and through a pressure regulator 77 and through a check valve 78, and intersects with the cold water feed pipe 24 at a connection point designated by numeral 80, and then this air line 72 extends through a pressure-responsive valve 82, and a check valve 84, after which it connects with the main hot water feed pipe 22 at a point designated by numeral 86.

It is to be understood that the compressor 62, the storage tank 74 and the actuator controlled valve 76 and associated components 77 and 78 are housed in a separate or protected location relative to the building structure 2. This separate, protected location may be above or below ground, whichever is more practicable in a particular instance. Thus, any fire in the building 2 cannot affect this source 83 of compressed air. The air control valve 76 has a handle 85 so that it can be turned open manually, if manual actuation should be desired for any reason. The pressure regulator 77 is set at a predetermined level approximately 15 to 35 p.s.i. above the water pressure as shown by a gage 87 connected to the water supply main 38. The exact pressure at which the regulator 77 is set is not critical, except that it should exceed the water pressure 87 by a significant amount so that the water is quickly purged out of the risers 22 and 24 after the air control valve 76 has been opened.

If desired a smaller auxiliary compressor may be provided for maintaining the tank 74 fully charged in spite of any minor leakage.

This auxiliary compressor is associated with a control which continually monitors the pressure in the tank 74 and automatically operates the auxiliary compressor from time to time for maintaining air pressure in tank 74 at the desired pressure level.

Before discussing the operation of the above-described system, it is to be noted that the hot and cold water pipes connected to each sink each include a conventional shut-off valve 88 and also include a pressure-responsive discharge valve 90. The shut-off valve 88 is normally in its open position and is provided for the purpose of manually shutting off the flow of water to the sink faucets during maintenance or repair operations. Likewise, the shut-off valves 40, 54 and 56 are normally in open position to permit water flow therethrough. Valve 76 is normally in a closed position so that compressed air is not introduced into the water supply system during normal operation of the building 2.

In operation of this life-sustaining method and system, a fire in the building 2 will actuate one of the fire detectors 58 which is closest to or most quickly affected by the fire. Actuation of any of the fire detectors 58 causes transmission of an electrical signal through the wires 64 and 66 of the actuated fire detector, and through the control circuit 68 and 70 which are electrically connected to both the air compressor 62 and the valve actuator 60. The electrical signal starts the air compressor running and simultaneously opens the valve 76 to permit pressurized air flow therethrough. The result is that air from the compressed air storage tank flows through the air pipe 72 and through the now open valve 76. Check valve 78 permits air flow in a direction towards the hot and cold water feed pipes 22 and 24, but prevents water from reaching the pressure regulator 77.

When the compressed air reaches the connection point 80 at which pipe 72 intersects the cold water feed pipe 24, a portion of the compressed air forces itself upwardly through the cold water feed pipe 22 as a result of its pressure level as set by the regulator 77. The air pressure is greater than that of the water pressure of the cold water from the trunk line 38, so that cold water is now prevented from travelling through the cold water supply line 38 beyond the check valve 48. The pressure of the air flowing up the cold water feed pipe 24 drives the existing water in that pipe ahead of the air, to effectively eject such water from that pipe through the various pressure-responsive discharge valves 90. These discharge valves 90 may be similar in construction to pressure-relief valves, except that they contain spring biased latches for holding them open, until manually returned to closed position. They are set at a pressure level above the normal pressure of the water in the feed pipes 22 and 24, but they are set at a level below the level of the pressure regulator 77. Thus, these discharge valves 90 normally remain closed. However, when the pressurized air surges up through the line 24 these discharge valves 90 become opened in response to the increased pressure resulting from the pressurized air flow through the water pipes, and they remain open until manually turned off.

The compressed air not travelling up the cold water feed pipe 24 continues to flow through the air pipe 72 towards the hot water feed line 22. The pressure of the compressed air is sufficient to open the pressure-sensitive valve 82, and the check valve 84 permits such air to continue to flow towards the hot water feed pipe 22. The compressed air cannot flow from the air pipe 72 into the outlet pipe 50 and towards the water heater 40, because the other check valve 52 prevents fluid flow in that direction. Accordingly, the compressed air flowing from the air pipe 72 at the connection point 86 must flow into the hot water feed pipe 22.

It is noted that the pressure-sensitive valve 82 normally remains closed, because it is set at a pressure level above the normal pressure level of the water in the hot and cold water pipes. Thus, the cold water cannot normally pass through the valve 82 and mix with the hot water. The check valve 84 in turn prevents the hot water from mixing with the cold water. Therefore, the cold water and hot water are normally isolated from each other. This pressure-sensitive valve 82 is set at a pressure level above the normal pressure of the water in the cold water line 24 and below the pressure of the pressure regulator 77. Thus, the increase in pressure resulting from the entry of pressurized air into the line 72 opens the valve 82. This valve 82 is constructed like a pressure-relief valve with a spring-biased latch which keeps the valve 82 open until the valve is manually reset. This valve 82 opens when the pressure in the line 72 between the connection 80 and the valve 82 exceeds its pre-set level and thereafter it remains open until manually reset.

As described previously, the pressurized air entering the connection 86 cannot flow through the check valve 52. This pressurized air is at a pressure greater than the pressure of the hot water normally flowing from outlet pipe 50. Accordingly, in a manner similar to that discussed above with respect to the cold water pipe, the pressure of the compressed air prevents the flow of the lower pressure hot water past the check valve 52. The air quickly drives the hot water out of the feed pipe 22 through the various discharge valves.

In summary of the above discussion, soon after the pressurized air is started flowing by the valve 76, the cold and hot water feed lines 24 and 22 are purged of their water content and pressurized air begins flowing into the bathrooms 10, 12, 14, 16, 18, 20 which can thereby serve as rooms of refuge for trapped occupants.

When the compressor is actuated, compressed air flowing through the pipes 22 and 24, as discussed above, flows into the individual feed or branch pipes 28 and 30 in each of the bathrooms 10, 12, 14, 16, 18 and 20 of the illustrated occupancy units. Preferably, the faucets 34 and 36 on any sink in a bathroom containing one or more trapped occupants will quickly be opened by the occupants so that the pressurized air can freely flow into the respective bathroom. In this respect, a sign may be provided above each sink instructing the occupants to close the bathroom door and to open the faucets in the event of fire. In any event, the pressure-sensitive discharge valves 90 mounted in the pipes 28 and 30 of each sink 32 are set so that the pressure of the compressed air is sufficient to automatically open these valves. Consequently, pressurized air will flow out the valves 90 even if the faucets on the sink are not opened. In this manner, trapped occupants awaiting rescue will be provided with sufficient air to sustain life and to aid in excluding smoke or noxious fumes or heated air from the bathroom until the arrival of rescuers.

Another advantage of the pressurized air is that upon its release through the faucets 34, 36 and/or its release through the discharge valves 90, the air immediately expands in volume while its pressure drops. Therefore, even though it is being supplied through relatively small-diameter water pipes, it will constitute a significant volume of breathable air flowing into each room of refuge during each second of time as it expands upon entry into the room. Furthermore, the sudden expansion of the compressed air will inherently cause its temperature to decrease, which will provide a welcome cooling effect for the trapped occupants.

Once there is assurance that all of the occupants have been removed from the building, the flow of compressed air may be terminated by deactuating the compressor 62 and closing the valve 76 at the outlet of the air storage tank 74. These operations are performed manually.

The embodiment of the invention as described above is a method and system which advantageously uses existing small-diameter water pipes in a building to provide an emergency air supply system for occupants trapped in a fire. The system itself may be constructed as part of a new building, or may be retrofitted into an existing building. The system uses relatively few components and thus can be quickly and relatively economically installed.

As used herein the term "small-diameter pipes" or "small-diameter piping" is intended to mean the size of piping conventionally used to feed water to the various occupancy units in a building in distinction to the large diameter ducts which would be required to feed conditioned air from a central air conditioning and heating installation to the same occupancy units in that building. As the number of occupancy units in the building is increased, the diameter of the water feed lines is increased to accommodate the increased demand. By the same token, the air conditioning ducts would also be increased in cross-sectional area. Therefore, the water piping is still considered to be "small-diameter piping", because it is small relative to the size of the ducts which would be required to carry conditioned air from a central air conditioning and heating installation to all of the various occupancy units.

The embodiment of the invention discussed above is intended to be illustrative only, and not restrictive of the scope of the invention, that scope being defined by the following claims and all equivalents thereto.

What is claimed is:

1. The method of providing life-sustaining air to individual rooms of refuge, usually bathrooms or washrooms, in a building having hot and cold water supply pipes for providing hot and cold water to the individual occupancy units within said building, said method comprising the steps of:

providing a source of pressurized air in a safe location with respect to fire in the building, connecting said source of pressurized air to at least one of the water supply pipes in said building which communicates with the various rooms of refuge, and feeding the pressurized air from said source of pressurized air through said water supply pipe into the respective rooms of refuge in the event of a fire in the building, whereby pressurized air is supplied through the water pipe to the rooms of refuge in the building for providing life-sustaining air to any persons trapped in such rooms, while the resultant influx of pressurized air aids in excluding smoke and fumes from such rooms in which trapped occupants may barricade themselves.

2. The method of providing life-sustaining air to individual rooms of refuge in the building as claimed in claim 1, wherein:

the pressure of the air fed through said water supply pipe is greater than the pressure of the water normally in said water supply pipe.

3. The method of providing life-sustaining air to individual rooms of refuge in the building as claimed in claim 1, further including the steps of:

connecting said source of pressurized air to both the hot and cold water supply pipes in the building, and feeding the pressurized air through both of said water supply pipes to the respective rooms of refuge in the event of a fire in said building.

4. The method of providing life-sustaining air to individual rooms of refuge in the building as claimed in claim 3, wherein:

the pressure of the air fed through said hot and cold water supply pipes is greater than the pressure of the water normally in both the hot and cold water supply pipes.

5. The method of providing life-sustaining air to individual rooms of refuge in a building as claimed in claim 1, 2, 3 or 4, including the step of:

providing for detecting the occurrence of a fire in said building and generating an electrical signal in response to such detection, and automatically feeding the pressurized air from said source through said water supply pipe(s) to the various rooms of refuge in response to said signal.

6. The method of providing life-sustaining air to individual rooms of refuge in a building as claimed in claim 1, 2, 3 or 4, including the step of: automatically releasing the pressurized air from the water supply pipe(s) into the respective rooms of refuge for allowing the flow of pressurized air to enter such rooms regardless of whether the water faucets are opened by the trapped persons.

7. The method of providing life-sustaining air to individual rooms of refuge in a building as claimed in claim 1, 2, 3 or 4, including the steps of:

automatically detecting the occurrence of fire in the building, automatically feeding the pressurized air from said source through the water pipe(s) to the various rooms of refuge upon the detection of a fire, and automatically releasing the pressurized air from the water supply pipe(s) into the respective rooms of refuge for allowing the pressurized air to enter such rooms regardless of whether the faucets have been opened by any trapped person.

8. The method of retrofitting an existing building with a system for providing life-sustaining air to individual preselected rooms of refuge, usually bathrooms or washrooms in the respective occupancy units within the building, said building having existing hot and cold water supply pipes for providing water to the individual occupancy units of the building, the steps of said method including:

providing a source of pressurized air in a safe location with respect to fire in the building, connecting said source of pressurized air to at least one of the water supply pipes in the building feeding into the various rooms of refuge, and feeding the pressurized air from said source of air through said water supply pipe(s) in the event of a fire into the respective rooms of refuge in the building for providing life-sustaining air to any persons trapped in such rooms and for aiding in excluding smoke and fumes from such rooms in which trapped occupants may barricade themselves.

9. The method of retrofitting an existing building with a system for providing life-sustaining air to individual preselected rooms of refuge as claimed in claim 8, wherein:

the pressure of the air supplied through said water supply pipe is greater than the pressure of the water normally in said supply pipe.

10. The method of providing life-sustaining air to individual rooms of refuge in a building as claimed in claim 8, further including the step of:

connecting said source of pressurized air to both the hot and cold water supply pipes in the building, and supplying the pressurized air through both said hot and cold water supply pipes into the respective rooms of refuge in the event of a fire in the building.

11. The method of providing life-sustaining air to individual rooms of refuge in a building as claimed in claim 10, wherein:

the pressure of the air supplied through the hot and cold water supply pipes is greater than the pressure of the water normally in each of said hot and cold water supply pipes.

12. A system for automatically providing pressurized air to preselected rooms in a building for sustaining life of occupants trapped therein by a fire, said system utilizing the water feed pipes of said building to provide such air therein, said system comprising:

means for providing pressurized air connected to at least one of the water feed pipes that supply water to said preselected rooms in the respective individual occupancy units within said building, said air being provided at a pressure greater than the normal water pressure within said water feed pipe to which said air-providing means is connected, means for detecting a fire in said building for generating a signal in response to detection of the fire, and actuating means responsive to such signal for causing said air-providing means to supply pressurized air through the water feed pipes to said preselected rooms, whereby detection of a fire automatically actuates said air-providing means for providing pressurized air to said preselected rooms in the building through at least one water feed pipe in said building.

13. The system for automatically providing pressurized air to preselected rooms in a building as claimed in claim 12, wherein said building includes a first cold water feed pipe for supplying cold water to said preselected rooms in the respective individual occupancy units within said building and a second hot water feed pipe for supplying hot water to said preselected rooms within said building, in which:

said air-providing means for providing pressurized air is connected to both said first cold water feed pipe and to said second hot water feed pipe, and the pressure of said air is greater than the normal pressure of the water in either said first or said second feed pipes.

14. The system for automatically providing pressurized air to preselected rooms in a building as claimed in claim 12, wherein said means for providing pressurized air includes:

a compressor, a compressed air storage tank coupled to said compressor, and a compressed air pipe coupled at its inlet to said compressed air storage tank and coupled at its outlet to at least one water supply pipe, and said means for detecting a fire is electrically connected to said compressor for automatic actuation thereof upon detection of a fire.

15. The system for automatically providing pressurized air to preselected rooms in a building as claimed in claim 14, further including:

a shut-off valve in said compressed air pipe coupled to the outlet of said compressed air storage tank, such that compressed air is provided to at least one of said water feed pipes from said compressed air storage tank through said compressed air pipe only when said shut-off valve is opened.

16. The system for automatically providing pressurized air to preselected rooms in a building as claimed in claim 15, wherein:

said means for detecting a fire is electrically coupled to said shut-off valve for said signal from said detecting means to open said shut-off valve to allow flow of compressed air from said compressed air storage tank through said compressed air pipe and into at least one water supply pipe.

17. The system for automatically providing pressurized air to preselected rooms in a building as claimed in claim 12, 13, 14, 15 or 16, in which:

means are provided for automatically releasing the contents of such water feed pipe(s) into the respective rooms of refuge when the compressed air is introduced into such pipe(s) for allowing the compressed air to enter the rooms of refuge regardless of whether the faucets are opened.

18. The system for providing pressurized air to preselected rooms of refuge in a building as claimed in claim 16, in which:

at least one pressure-responsive discharge valve is connected to such a water supply pipe in each room of refuge for automatically discharging the contents of the pipe into the room when the pressure in the pipe increases as a result of the introduction of compressed air into the water supply piping for allowing the compressed air to enter the room regardless of whether the faucet is opened.

19. A system for providing pressurized air to preselected rooms of refuge in a building having at least a hot water supply pipe and a cold water supply pipe for providing hot and cold water to such rooms in the building, said system comprising:

means for providing compressed air to said hot and cold water supply pipes, said means including a compressed air pipe having its inlet end coupled to a source of compressed air, the outlet portion of said compressed air pipe interconnecting with both said hot and cold water supply pipes to provide compressed air thereto, control means associated with the outlet portion of said compressed air pipe for normally preventing the compressed air from entering through said outlet portion, isolating means disposed within said compressed air pipe between said hot and cold water supply pipes for normally isolating the water in said hot and cold water supply pipes from each other, said isolating means being responsive to the flow of pressurized air through said compressed air pipe for allowing the compressed air to enter both the hot and cold water pipes, means for actuating said control means for allowing compressed air to flow through said outlet portion of the compressed air pipe, said means for providing compressed air being adapted to provide compressed air at a pressure greater than the normal water pressure in both said hot and cold water supply pipes and greater than the pressure required to open said isolating means, whereby upon the occurrence of a fire said control means is actuatable for providing compressed air through said hot and cold water supply pipes into the preselected rooms in a building for sustaining the life of any persons trapped in such rooms and for slightly elevating the air pressure in such rooms for aiding in excluding smoke and fumes therefrom.

20. The system for providing pressurized air to preselected rooms of refuge in a building as claimed in claim 12 or 19, further including:

check valve means in said water supply pipes for allowing fluid flow to occur from said source of compressed air through said water supply pipes only in the direction from said source of compressed air towards said rooms of refuge.

21. A system for providing pressurized air to preselected rooms in a building for sustaining the life of occupants trapped therein by a fire, said system utilizing at least one of the water feed pipes supplying water to the rooms of the building for supplying air to said rooms, said system comprising:

a source of pressurized air adapted to be selectively coupled in fluid flow relationship to at least one of the water feed pipes that supplies water to said preselected rooms, the pressure of said air from said source being greater than the normal water pressure within said at least one water feed pipe to which said source is selectively coupled, and means for feeding said pressurized air from said source through said at least one of the water feed pipes for providing said air from said source to said preselected rooms in the event of a fire, whereby life sustaining air from said source can be provided to said preselected rooms through said at least one water supply feed pipe.

* * * * *